US009388646B2

(12) United States Patent
Elsayed

(10) Patent No.: US 9,388,646 B2
(45) Date of Patent: Jul. 12, 2016

(54) DOUBLE CURVED SPIDER GRIPPING DIE

(71) Applicant: Mostafa Elsayed, Broussard, LA (US)

(72) Inventor: Mostafa Elsayed, Broussard, LA (US)

(73) Assignee: Vermilion River Tool & Equipment Company, Inc., Lafayette, LA (US)

( * ) Notice: Subject to any disclaimer, the term of this patent is extended or adjusted under 35 U.S.C. 154(b) by 0 days.

(21) Appl. No.: 14/212,439

(22) Filed: Mar. 14, 2014

(65) Prior Publication Data

US 2014/0265395 A1 Sep. 18, 2014

Related U.S. Application Data

(60) Provisional application No. 61/784,317, filed on Mar. 14, 2014.

(51) Int. Cl.
*B66C 1/62* (2006.01)
*E21B 19/10* (2006.01)

(52) U.S. Cl.
CPC ..... *E21B 19/10* (2013.01)

(58) Field of Classification Search
CPC ..... E21B 19/10; B66C 1/62
USPC ..... 294/102.1, 102.2, 104, 106, 902; 166/77.52, 77.53
See application file for complete search history.

(56) References Cited

U.S. PATENT DOCUMENTS

| | | | | | |
|---|---|---|---|---|---|
| 2,127,108 | A * | 8/1938 | Driscoll | 188/67 |
| 2,156,384 | A * | 5/1939 | Fluellen | 175/423 |
| 2,493,556 | A * | 1/1950 | Stone | 294/102.2 |
| 3,272,038 | A * | 9/1966 | Burstall | 81/186 |
| 3,368,252 | A * | 2/1968 | Meek, Sr. | 294/102.2 |
| 3,589,742 | A * | 6/1971 | Flick | 81/57.18 |
| 4,332,062 | A * | 6/1982 | Byrne, Jr. | 188/67 |
| 4,709,599 | A * | 12/1987 | Buck | 81/57.18 |
| 4,712,284 | A * | 12/1987 | Coyle et al. | 29/240 |
| 4,751,651 | A * | 6/1988 | Bryan | 700/197 |
| 4,836,064 | A * | 6/1989 | Slator | 81/57.18 |
| 4,869,862 | A * | 9/1989 | Bryan | 425/380 |
| 5,971,086 | A * | 10/1999 | Bee et al. | 175/423 |
| 7,267,168 | B1 * | 9/2007 | Sipos | 166/77.52 |
| 7,775,270 | B1 | 8/2010 | Sipos | |
| 8,061,418 | B2 * | 11/2011 | Angelle et al. | 166/77.52 |
| 2005/0188793 | A1 * | 9/2005 | Cherry | 81/57.33 |
| 2006/0011017 | A1 * | 1/2006 | Kathan | 81/57.18 |
| 2008/0022811 | A1 * | 1/2008 | Kathan | 81/57.18 |
| 2014/0262497 | A1 * | 9/2014 | De France et al. | 174/84 C |

* cited by examiner

*Primary Examiner* — Paul T Chin

(57) ABSTRACT

A double curved face gripping die for engaging tubular pipe of varying diameters is comprised of opposing mirror imaged curved die surfaces forming a modified V-shape. Each curve die surface has a double curved contact surface of a desired varying radius, the distal ends of the contact surfaces extending outward limn the pipe to avoid pipe contact. The die incorporates the contact strength and flexibility of a V-shaped gripping d with minimal scratching or gouging of the pipe.

12 Claims, 7 Drawing Sheets

DOUBLE CURVED SPIDER GRIPPING DIE

PRIORITY

This application claims priority to U.S. Provisional Application Ser. No. 61/784317 filed Mar. 14, 2013 for Double curved Spider Gripping Die, the entire content of which is incorporated by reference.

FIELD OF THE INVENTION

The present invention pertains to pipe gripping dies used in conjunction with pipe slips for rotary spiders and elevators used for exploration of oil and gas. More specifically the invention pertains to a gripping die having opposing mirror imaged curved pipe contact surfaces, each opposing pipe contact surface comprised of a curved pipe surfaces forming a compound curve.

BACKGROUND OF THE INVENTION

A pipe string being assembled in a wellbore is supported at or near the upper end by a spider that rest on the drilling rig floor or by an elevator that is suspended from the rig traveling block above the pipe string. As the wellbore becomes deeper, additional sections of pipe are added to the pipe string. Conversely, removal of the pipe string from the wellbore requires the removal of pipe section from the string. To facilitate adding and subtracting pipe sections from the pipe string the spider engages with the pipe string to prevent it from falling into the wellbore.

To support the weight of the pipe string while additional pipe sections are added to the pipe string, a plurality of slips extending downward from the spider are engaged inward to compress against the surface of the pipe. These slips have gripping surfaces called dies that contact and hold the outer surface of the pipe. A plurality of gripping dies, usually three or more, are vertically distributed on each slip.

The weight of the pipe string on the spider slips increases the inward force applied by the slips and gripping dies against the pipe face. The gripping dies often receive substantial torque transmitted from the spider to the pipe. The torque is often collateral with other rig floor activities. Gripping dies that have teeth on a cylindrical surface that approximates the pipe outer cylindrical surface tilt somewhat as a result of machine slack and strain when torque is being, transmitted to the pipe. When the dies are tilted, one edge of the dies tends to gouge into the pipe. The resulting load concentration tends to distort the pipe with the unintended consequence of pipe surface damage. This pipe surface damage can result in fatigue and failure of the pipe over extended periods of use.

Curved dies are typically shaped to correspond with a specific diameter pipe so as to engage with a maximum area of a pipe. Because of this, the gripping dies of the spider must frequently be exchanged with gripping dies having a different curvature when the need for switching between pipes of different sizes arises.

To increase versatility of the die and simultaneously minimize gouging of the pipe, a V-shaped gripping die as disclosed in U.S. Pat. No. 7,775,270 to D. Sipos can be used in lieu of traditional curved dies. Such a V-shaped die is composed of two wide flat surfaces that combine at an apex to form a V-shaped flat contact surface that engages the pipe along two vertical lines away from the outer edges of the die. Because V-shaped gripping dies do not make contact with the pipe with an edge, loads are more evenly distributed over the die surface. This serves to reduce gouging of the pipe during use and while accommodating use with a variety of pipe diameters. However, as the weight of the pipe string increase the two vertical lines of contact between die and pipe surface may concentrate the gripping force on the pipe causing an unintended increase in the incidence of markings on the pipe surface. These markings may weaken the pipe and, over the course of use increase the risk of damage or failure of the pipe.

SUMMARY OF THE INVENTION

The double carved gripping die of the present invention seeks to overcome the shortcomings associated now associated with both curved and V-shaped pipe gripping dies. Rather than a V-shaped die with two flat die surfaces forming the apex of a V-shape, the die employs too opposing curved surfaces joined to create an apex, essentially creating a modified or "curved" V-shape die. Each of the joined curved die surfaces has a pipe contact surface comprised of a first and a second curve segments, each of a different radius. The first and second curve segments have a line of curvature forming a compound curve.

When the dies are arranged in a spider or elevator around a pipe string to hold a pipe, the pipe is initially in contact with only the first curve segment of each die pipe contact surface. As the depth of the well increases, the weight of the pipe string is increased and the load transmitted to the dies is also increased causing the pipe to deflect. As the pipe deflects the second curve segment of each die pipe contact surface becomes in contact with the pipe to create a larger surface area of contact between the die and pipe. This larger surface area reduces load concentrations that may tend to gouging, marking, and increased stress on the pipe surface. The two double-curved surfaces of the gripping die serve to optimize contact between the die and pipe surface while simultaneously providing the flexibility to switch between pipes of varying diameter without the need to change dies. The advantages and features of this invention will be apparent to those skilled in the art from a consideration of this specification, including the attached claims and appended drawings.

DETAILED DESCRIPTION OF DRAWINGS

Figure 1:
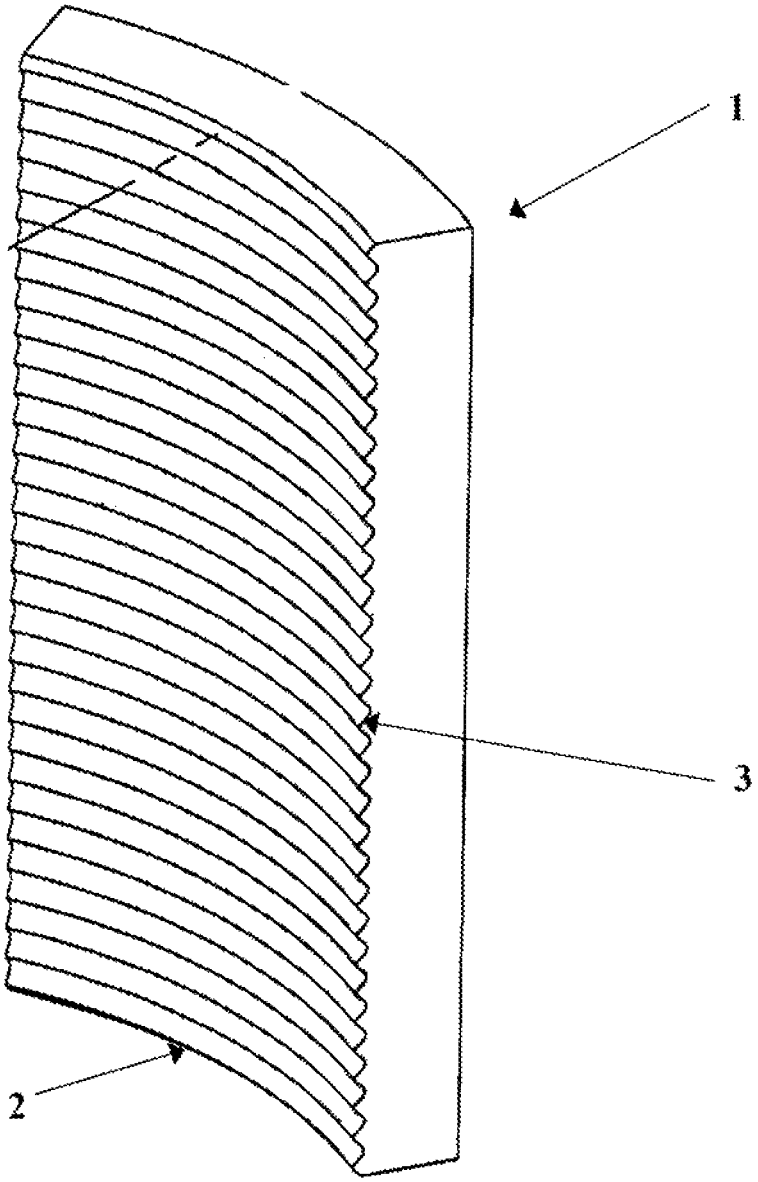
FIG. 1 (PRIOR ART)
FIG. 1 is a perspective view of a prior art curved gripping die.

Unless otherwise specified, the illustrated embodiments can be understood as providing exemplary features of varying detail of certain embodiments, and therefore, unless otherwise specified, features, components, elements, and/or aspects of the drawings can be otherwise combined, interconnected, sequenced, separated, interchanged, positioned, and/or rearranged without materially departing, from the herein disclosed invention. Additionally, elements illustrated in the drawings are provided primarily to facilitate understanding of the disclosed technology and are not necessarily drawn to scale or with precise accuracy.

FIG. 1 illustrates a perspective view of a traditional curved gripping die (1). An inner facing surface (2) of the die (1) is curved at a desired radius to receive a tubular pipe surface. A plurality of teeth (3) horizontally located on the surface (2) of die (1) engage with the outer surface of a pipe to prevent the pipe from slipping therefrom. Die surface (2) has a radius of curvature with a specific size to correspond with the radius of the pipe surface to be gripped.

When changing between pipes, the gripping die (1) must be replaced with a different sized die (1) such that the curved surface (2) of the new die (1) has a radius of curvature equal to the radius of the pipe being gripped.

When rotational torque is transmitted to a pipe through the die (1), the die (1) tilts as a result of machine slack and strain. When die (1) tilts, one edge of the die (1 ) tends to gouge into the attached pipe. The resulting load concentration on the pipe distorts the pipe with unplanned consequent pipe surface damage. Over time this damage can weaken the pipe and cause fatigue and failure.

Figure 2:
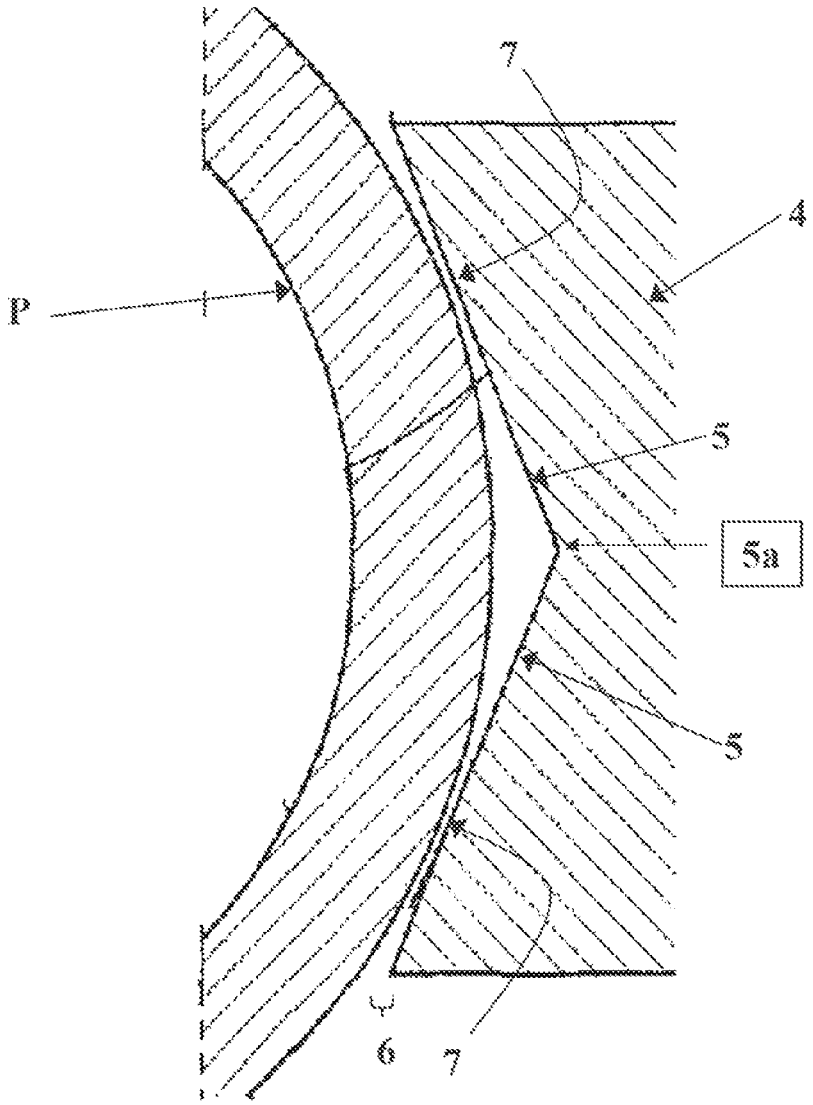
FIG. 2 (PRIOR ART)
FIG. 2 is a top view of a prior art V-shaped gripping die.

FIG. 2 illustrates a top view of a V-shaped gripping die (4) as recited in U.S. Pat. No. 7,775,270 to D. Sipos. V-shaped gripping dies (4) allow use with pipes (P) of varying diameter and maintain a load distribution away from the die edge. The V-shaped gripping die (4) has two angled gripping surfaces (5) that create the V at the insertion or apex (5*a*) of the gripping surfaces (5). Pipe (P) makes contact with surfaces (5) at finite contact points (7*a*, 7*b*) along the length of the pipe creating a distance (6) between the pipe (P) and die (4). The contact points (7*a*, 7*b*) extend vertically on pipe (P) the length of die (4) and the resulting vertical lines of contact with pipe (P) formed at contact points (7*a*, 7*b*) have a stabilizing effect on pipe (P) and die (4). The points (7*a*,7*b*) and distance (6) prevent the edges of die (4) from gouging into the attached pipe (P) as was a problem with traditional curved dies (1), like that shown in FIG. 1.

The load between the die (4) and pipe (P) is applied along the two contact points (7*a*, 7*b*) on a finite surface area along the length of the pipe (P). As the weight of the pipe string increases, the pipe (P) will temporarily deform and the die may create markings on the surface of the pipe (P). These markings can disrupt pipe surface coatings and may cause fatigue in pipe (P) increasing the risk of failure of both pipe (P) and die (4).

Figure 3:
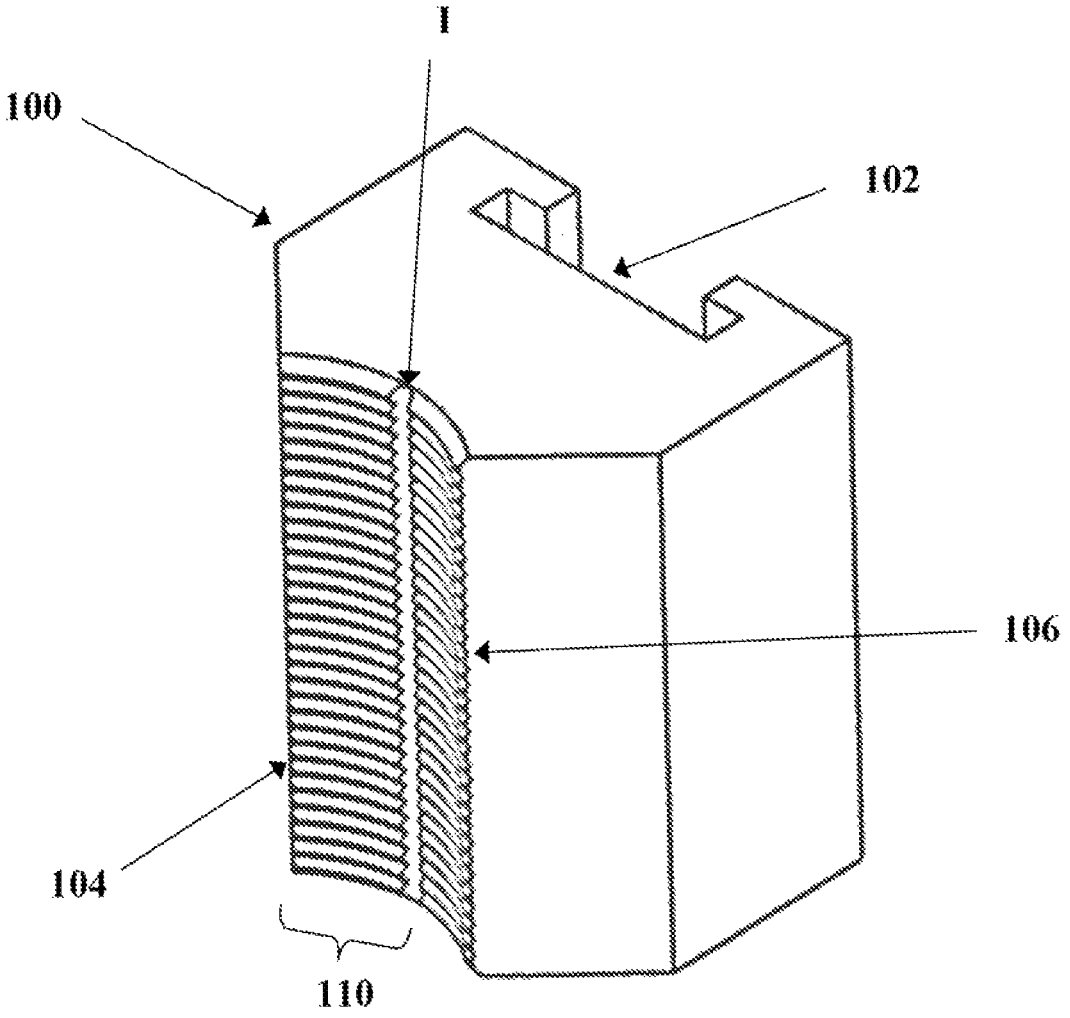
FIG. 3 is a perspective view of the double curved gripping die of the present invention.

FIG. 3 illustrates a perspective view of a double curved surface pipe gripping die (100) of the present invention. Each die (100) engages with the slip of a spider or elevator (not shown) at a rear channel (102). The spider translates force from rear channel (102) through die (100) to a curved pipe contact surface (104) comprised of two curved contact faces (110) mirrored around a vertical central line (1). The pipe curved surface (104) engages with the outer surface of a pipe A plurality of teeth (106) on contact faces (110) engage with the outer surface of a pipe and prevent the pipe from sliding or disengaging from pipe contact surface (104).

Figure 4:
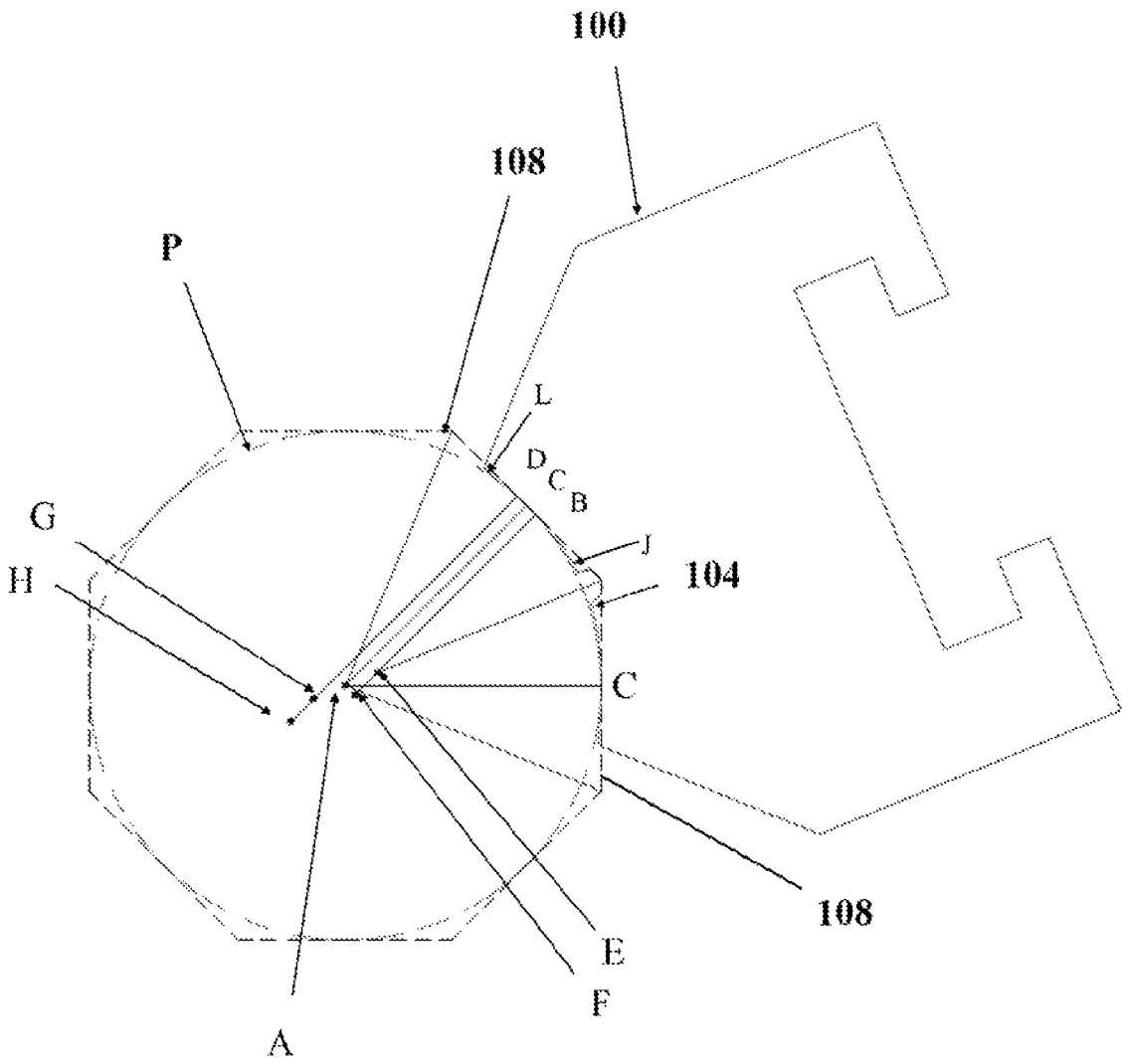
FIG. 4 is a schematic top view of the gripping die of FIG. 3.

FIG. 4 is an enlarged schematic top view of die (100) shown in FIG. 3 presenting one contact face (110) of the curved pipe surface (104) engaged with pipe (P). Lines (108) represent the line tangent to the outer surface of a pipe (P) which would correspond to the flat angled gripping surfaces (5) of the V-shaped die (4) shown in FIG. 2.

In the V-shaped configuration represented by dashed lines (108) the die (100) makes contact with pipe (P) at two finite locations regardless of the diameter of pipe (P). These locations of contact between die (100) and pipe (P) change as pipe (P) changes in diameter. Die (100) engages with a first pipe (P1) having radius (AC) at a first contact point (C); die (100) engages with a smaller pipe (P2) having radius (EB) at a second contact point (B); and die (100) engages with a larger pipe (P3) having radius (GD) at a third contact point (D). Single point interaction at contact points (B, C, D) creates minimal surface contact between pipes (P1,P2,P3) and die (100) which results in load concentrations on pipes (P1, P2, P3) at points (B,C,D). These load concentrations cause dies (100) to scratch and gouge into pipes (P) Which ultimately leads to fatigue and failure of pipe (P).

To avoid scratching and gouging of pipe (P), while simultaneously allowing a single die (100) to engage with a range of pipe sizes, the flat angled gripping surfaces (5) of the V-shaped die (4) represented by dashed lines (108) are modified to create a larger zone of contact between pipe (P) and die (100) that is provided by curved pipe contact faces (110). Each curved contact face (110) curves outward or extrude toward pipe (P) from the straight profile of the flat V-shaped die represented by dashed line (108) and are comprised of an inner curved segment The outer curved segment (110B) and the inner curved segment (110A) are created by arcs positioned tangent to dashed lines (108) at points (B) and (D). Curvature line (.BJ) has a radius of curvature FB tangent to dashed lines (108) along line (P2). Curvature line DL) has a radius of curvature (GD) tangent to dashed lines (108) along line (P3). Radius (AC) is larger than radius (EB) by a distance (FE) which is defined as the distance between points (F) and (E). Intermediary points (F) and (H) extend parallel beyond radii (EB) and (GD), respectively, by distance (FE). Curvature lines (BJ) of inner curved segment (110A) and curvature line (DL) of outer curved segment (110B) form a compound curve of circular arcs of successively longer radii that are joined tangentially without reversal of curvature creating a compound curve.

The inner curved segment (110A) and outer curved segment (110B) facilitate a larger zone of contact between pipe (P) and die (100). As the die (100) is urged toward a pipe (P), the compression there-between causes both the die (100) and pipe (P) to deform. As the die (100) and pipe (P) deform the zone of contact therein increases, allowing the resulting contact stress to be spread over a wider surface area. This larger zone of contact reduces marking and gouging on the surface of the pipe (P) caused by die (100).

Distance (114) illustrates the distance at the distal ends of faces (110) between tangent line (108) of a die having a fiat surface profile and pipe (P). Distance (116) illustrates the reduced distance between curved pipe contact surface (104) of the die (100) of the present invention and pipe (P) at the same location. Because of this reduced distance (116), as pipe (P) deforms under loading the pipe deformation expands the area of the pipe engagement with the pipe contact die (100) from a portion of curved segment (110A) to include a portion of curved segment (110B) that comprise each contact face (110) of pipe contact surface (104) and increases the overall surface contact of die (100) with pipe (P).

The outer curved surface (110B) and the inner surface (110A) allow the faces (110) of die (100) to engage with pipes (P) having diameters ranging from smaller pipe (P2) to larger pipe (P3), the greater the pipe diameter the greater areas of contact with the die faces. The curvature of curved segments (110A, 110B) of each contact face (110) may be adjusted to engage with a range of differently sized pipe. This flexibility allows die (100) to be paired and used with pipe in a variety of size ranges while simultaneously preventing or minimizing die tilting caused by machine slack and strain and by design and manufacturing tolerances.

In an alternative embodiment of die (100), curvature lines (BJ) and (DL) can be formed with arc lines having radii of curvature (FB) and (HD), respectively, both running tangent to contact point (C) rather than tangent to separate contact points (B) and (D). In this configuration the surface (104) of die (100) does not contain a tangent or straight section between points (B) and (D) but rather two adjoining cured surfaces (BJ, DL) meeting at a single contact point (C) to form a compound curve. While this embodiment reduces contact surface area between pipe (P) and die (100) from the preferred embodiment discussed above and as illustrated in FIGS. 3-7, the difference is insignificant. Die (100) will have enhanced gripping, properties over the prior art regardless of the existence of straight section between points (B) and (D) on surface (104).

Figure 5:
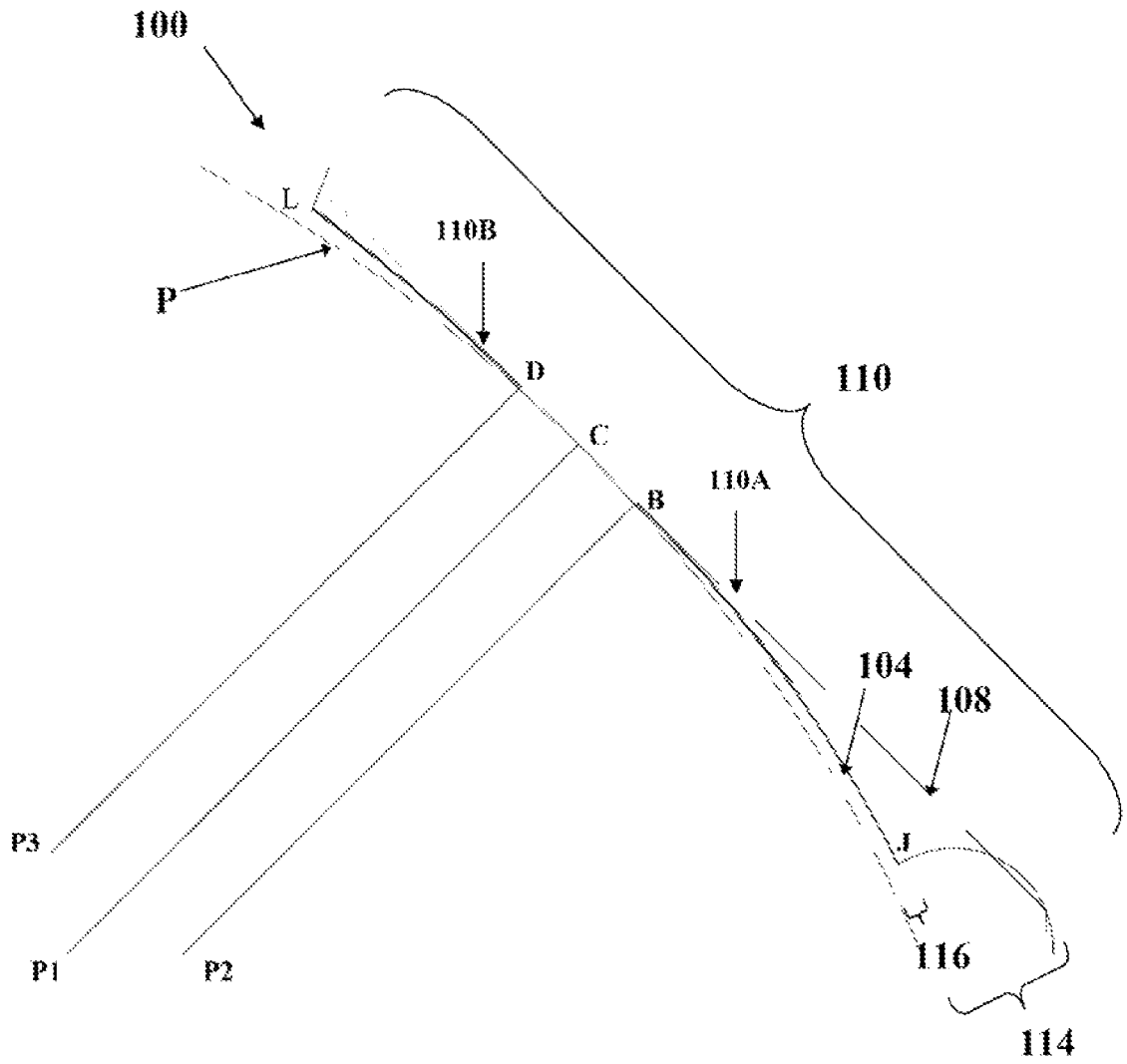
FIG. 5 is an enlarged partial schematic top view of one face of the gripping die engaged with a pipe surface.

It is easiest to understand the curved configuration of die (100) of FIG. 3 by comparing the curved pipe faces (110) of pipe contact surface (104) to the flat angled gripping surfaces (5) of V-shaped die (4) illustrated in FIG. 2, which are also represented by dashed lines (108) shown in FIG. 4. This comparison is illustrated in FIG. 5, a schematic top view of only one of the pair of curved pipe contact faces (110) of die (100) engaged with a pipe (P). Dashed lines (108) represent an angled gripping surface (5) of the V-shaped die configuration shown in FIG. 2.

Curved pipe face (110) is modified from dashed lines (108) to include a proximal inner curved segment (110A) and a distal adjoining outer curved segment (110B), shown respectively along curvature lines (RJ) and (DL), which curve outward or extrude toward pipe (P) from a flat surfaced V-shaped die represented by dashed line (108). Distance (114) illustrates the distance between the V-shaped die surface represented by (108) and pipe (P) at the distal ends of segments (110B) of pipe contact faces (110). Distance (116) illustrates the reduced distance between pipe contact faces (110A) of the present invention and pipe (P) at the proximal ends of segment (110A). The difference between distances (114) and (116) best illustrates the utility of the present invention. As pipe (P) deforms to engage die (100) of the present invention the pipe is engaged by curved pipe face (110) along curvature lines (BJ) and (DL) to increase surface contact area between the pipe (P) and face (110) of die (100).

Inner curvature line (BJ) of segment (110A) and outer curvature line (DL) of segment (110B) are created by arcs positioned tangent to dashed lines (108) at points (B) and (D), respectively. Curvature line (BJ) has a radius of curvature FB tangent to dashed lines (108) along line (P2). Curvature line (DL) has a radius of curvature HD tangent to dashed lines (108) along line (P3). These curvature lines (BJ) and (DL) form a compound curve of Inner curved segment (110A) and outer curved segment (110B) form a compound curve, i.e. curve of two circular arcs of successively longer radii without reversal of curvature, and allow the faces (110) of die (100) to engage with pipes (P) having diameters ranging from smaller pipe (P2) to larger pipe (P3) with greater areas of contact there-between. The profile of die (100) between points (J) and (L) represents one face (110) of the double-curved, surface die (100). The methodology outlined above is repeated on a second face (110) of die (100) mirrored around centerline (I) that form the curved die (100) as shown in FIG. 3.

In an alternative embodiment, as discussed above, curvature line (BJ) of face segment (110A) and curvature fine (DL) face segment (110B) can be formed tangent to contact point (C) along line (P1). In the alternative embodiment, curvature line (BJ) has radius of curvature (FB) along line (P1) and curvature line (DL) has radius of curvature (HD) along line (P1) to form a compound curve that meet at contact point (C) and that eliminates straight or tangent section (BD) between curved face segments (110A) and (110B).

Figure 6:
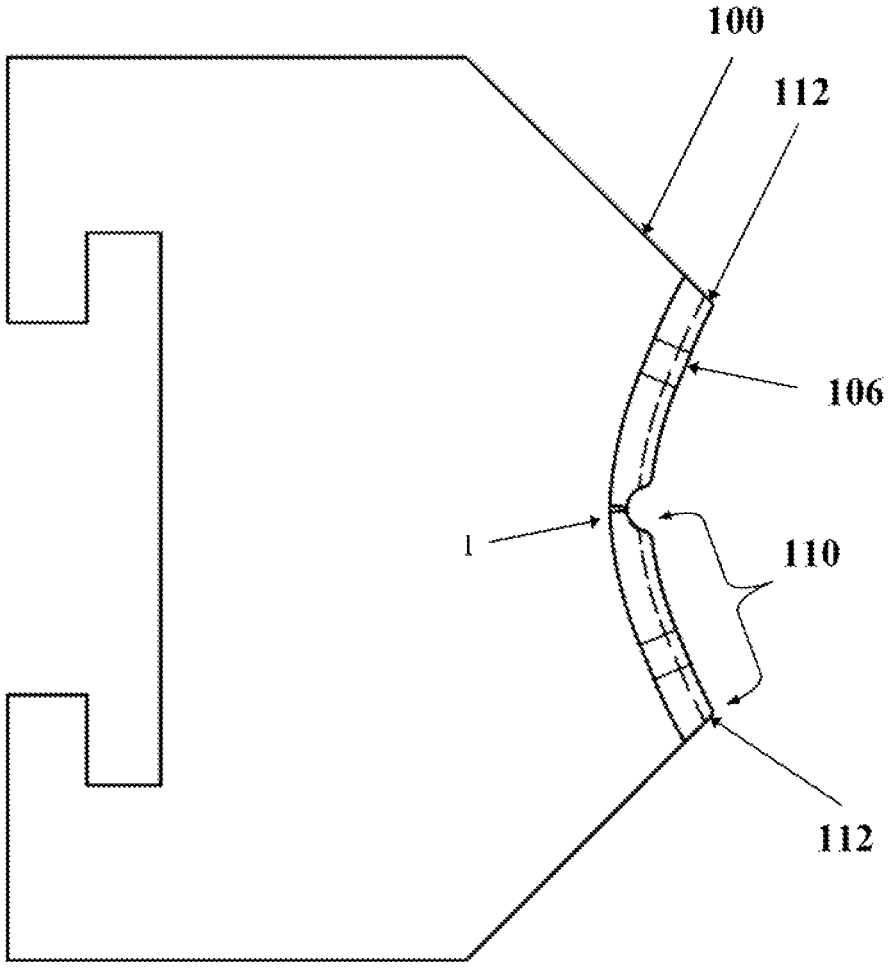
FIG. 6 is a top view of the double curved gripping die of FIG. 3.

FIG. 6 shows a top view of die (100). Teeth (106) make contact with a pipe along outer circumference of the pipe. Faces (110) of die (100) are identically mirrored around centerline (1). Two end points (112) located at the ends of faces (110) of die (100) are positioned a sufficient distance from the contact point between a pipe and die (100) to eliminate end-loading on the die (100) and to prevent die (100) from cracking or chipping at end points (112) when exposed to maximum pipe diameter and load. End points (112) are also curved to avoid finite end-loading on die 100). When engaged with a pipe, end points (112) of die (100) are not in direct contact with the outer surface of the pipe.

Figure 7:
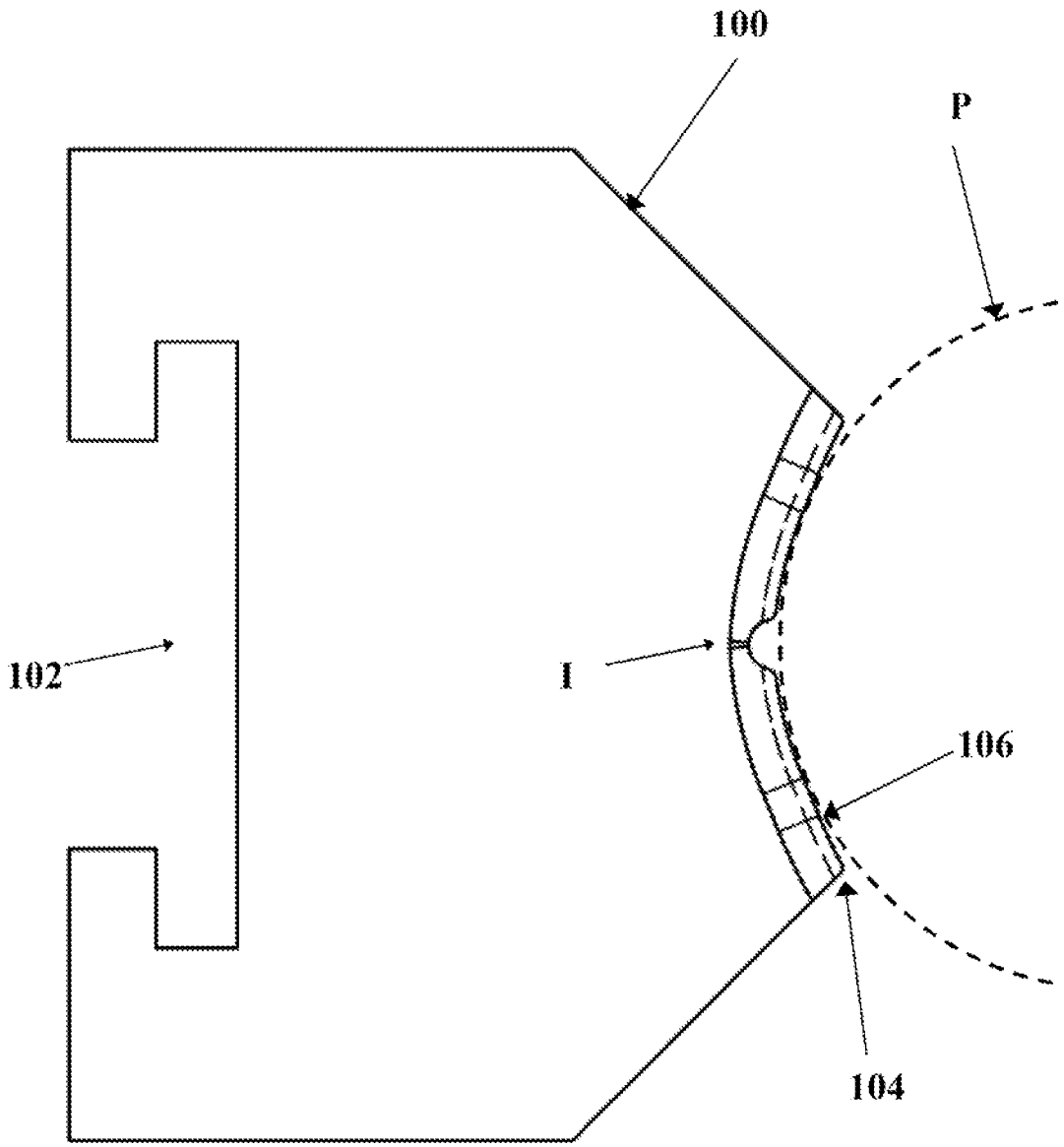
FIG. 7 is similar to FIG. 6, but shows the gripping die engaged with a pipe surface.

FIG. 7 is similar to FIG. 6, additionally illustrating die (100) engaging with a segment of pipe (P). Die (100) is urged towards pipe by slips (not shown) that insert into channel (102). As a plurality of slips engage inward towards pipe (P), surface (104) of die (100) compresses against the outer sin face of pipe (P). Surface (104) and pipe (P) deform slightly such that teeth (106) engage with outer surface of pipe (P). Because each die (100) has a contact face (110) with four separate curved segments—the mirrored curved face segments (110A) and (110B) on each face (110)—a combination of dies (100) around the circumference of pipe (P) optimizes the contact points between dies (100) and pipe (P) so as to allow a die (100) to receive pipes (P) of varying diameter while simultaneously preventing die tilt and gouging of pipe (P).

I claim:

1. A pipe gripping die comprising:

(a) pipe contact face having a first curved die surface and an opposing second curved die surface, wherein said first curved die surface and said opposing second curved die surface are positioned to form a V-shaped pipe gripping surface;

(b) wherein each said first and second opposing curved die surfaces are comprised of at least a third curved die surface and an opposing fourth curved die surface, wherein said third curved die surface and said opposing forth curved die surface create an inner curved surface and an outer curved surface; and (c) wherein when separately urging a small, medium, and large pipe towards said third and fourth curved die surface, said small, medium, and large pipes engage said third and fourth curved die surfaces at a corresponding separate innermost contact point, a corresponding separate middle contact point, and a corresponding separate outermost contact point.

2. The die as recited in claim 1, wherein said inner curved surface is extended from said innermost contact point to an inner distal end of said pipe gripping face, said inner curved surface having a radius of curvature equal to the radius of said medium pipe.

3. The die as recited in claim 2, wherein said outer curved surface is extended from said outermost contact point to an outer distal end of said pipe gripping face, said outer curved surface having a radius of curvature equal to the combined radius of said large pipe and the distance between the radii of said medium pipe and said small pipe.

4. The die as recited in claim 3, wherein said inner curved surface and said outer curved surface comprise a compound curve.

5. The die as recited in claim 4, wherein said pipe contact face is mirrored across a central axis.

6. The die as recited in claim 5, wherein said first curved die surface and said opposing second curved die surface are curved for engaging a plurality of pipe of varying diameter.

7. A pipe gripping die comprising:

(a) a pipe contact face having a first curved die surface and an opposing second curved die surface; wherein each said first and second opposing curved die surfaces are comprised of at least a third curved die surface and an opposing fourth curved die surface; and wherein said first curved die surface and said opposing second curved die surface are positioned to form a V-shaped pipe gripping surface;

(b) wherein said third curved die surface and said opposing forth curved die surface create an inner curved surface and an outer curved surface; and (c) wherein when separately urging a small, medium, and large pipe towards said third and fourth curved die surfaces, said small, medium, and large pipes engage said third and fourth curved die surfaces at a corresponding separate innermost contact point, a corresponding separate middle contact point, and a corresponding separate outermost contact point.

8. The die as recited in claim 7, wherein said inner curved surface is extended from said innermost contact point to an inner distal end of said pipe gripping face, said inner curved surface having a radius of curvature equal to the radius of said medium pipe.

9. The die as recited in claim 8, wherein said outer curved surface is extended from said outermost contact point to an outer distal end of said pipe gripping face, said outer curved surface having a radius of curvature equal to the combined radius of said large pipe and the distance between the radii of said medium pipe and said small pipe.

10. The die as recited in claim 9, wherein said inner curved surface and said outer curved surface comprise a compound curve.

11. The die as recited in Claim 10, wherein said pipe contact face is mirrored across a central axis.

12. The die as recited in claim 11, wherein said first curved die surface and said opposing second curved die surface are curved for engaging a plurality of pipe of varying diameter.

* * * * *